US007975483B2

(12) United States Patent
Wieghardt

(10) Patent No.: US 7,975,483 B2
(45) Date of Patent: Jul. 12, 2011

(54) STEAM POWER PLANT AND ALSO METHOD FOR RETROFITTING A STEAM POWER PLANT

(75) Inventor: Kai Wieghardt, Mannheim (DE)

(73) Assignee: Siemens Aktiengesellschaft, Munich (DE)

( * ) Notice: Subject to any disclaimer, the term of this patent is extended or adjusted under 35 U.S.C. 154(b) by 597 days.

(21) Appl. No.: 12/083,668

(22) PCT Filed: Oct. 5, 2006

(86) PCT No.: PCT/EP2006/067096

§ 371 (c)(1),
(2), (4) Date: Apr. 16, 2008

(87) PCT Pub. No.: WO2007/045563

PCT Pub. Date: Apr. 26, 2007

(65) Prior Publication Data

US 2009/0229267 A1 Sep. 17, 2009

(30) Foreign Application Priority Data

Oct. 17, 2005 (EP) ..... 05022606

(51) Int. Cl.
*F01K 7/34* (2006.01)

(52) U.S. Cl. ..... 60/653; 60/677; 60/679

(58) Field of Classification Search ..... 60/653, 60/677–679
See application file for complete search history.

(56) References Cited

U.S. PATENT DOCUMENTS

| | | | | |
|---|---|---|---|---|
| 1,971,818 | A * | 8/1934 | Hoxie | 307/53 |
| 2,467,092 | A * | 4/1949 | Ostermann | 60/659 |
| 2,504,640 | A * | 4/1950 | Bryant | 60/660 |
| 2,540,691 | A * | 2/1951 | Reese et al. | 415/37 |
| 4,007,596 | A * | 2/1977 | Braytenbah et al. | 376/211 |
| 5,533,337 | A | 7/1996 | Kusayama | |
| 5,749,228 | A * | 5/1998 | Shiga et al. | 60/679 |

FOREIGN PATENT DOCUMENTS

| | | | |
|---|---|---|---|
| DE | 820600 | C | 11/1951 |
| EP | 1445429 | A1 | 8/2004 |
| FR | 1511106 | A | 1/1968 |
| JP | 3189333 | A | 8/1991 |

* cited by examiner

*Primary Examiner* — Hoang M Nguyen

(57) ABSTRACT

The invention relates to a steam power plant comprising at least one steam heater for preparing compressed steam, a main turbine, which is connected downstream of the steam heater, is arranged on a main drive shaft and is a high-pressure or medium-pressure turbine, and a secondary turbine, which is interposed between the steam heater and the main turbine and is arranged on a secondary drive shaft, characterized in that the secondary turbine has an at least 50% higher operating speed when compared with a nominal speed of the main turbine.

16 Claims, 1 Drawing Sheet

STEAM POWER PLANT AND ALSO METHOD FOR RETROFITTING A STEAM POWER PLANT

CROSS REFERENCE TO RELATED APPLICATIONS

This application is the US National Stage of International Application No. PCT/EP2006/067096, filed Oct. 5, 2006 and claims the benefit thereof. The International Application claims the benefits of European application No. 05022606.7 filed Oct. 17, 2005, both of the applications are incorporated by reference herein in their entirety.

FIELD OF INVENTION

The invention relates to a steam power plant with at least one steam heater for providing compressed steam, a main turbine which is connected downstream to the steam heater, arranged on a main drive shaft and designed for operation with high-pressure and/or intermediate-pressure steam, and also a secondary turbine which is connected between the steam reheater and the main turbine and arranged on a secondary drive shaft. The invention also relates to a method for retrofitting a steam power plant with at least one steam heater for providing compressed steam, and also a main turbine which is connected downstream to the steam heater, arranged on a main shaft and designed for operation with high-pressure and/or intermediate pressure steam. The method comprises the step of retrofitting the thermal power plant with a secondary turbine which is arranged on a secondary drive shaft. The aforementioned main turbine, which is designed for operation with high-pressure and/or intermediate pressure steam, can be constructed as a separate high-pressure turbine, as a separate intermediate-pressure turbine or as a combined high-pressure/intermediate-pressure turbine. High-pressure turbines as a rule are designed for a temperature of 520 to 600° C. and a pressure of 120 to 300 bar. Intermediate-pressure turbines, on the other hand, as a rule are designed for absorption of 520 to 620° C. hot steam with a pressure of 30 to 60 bar. The steam generator of the steam power plant can utilize different heat sources for steam generation, especially also the exhaust gas of a gas turbine. In this respect, the steam power plant can also be part of another power plant.

BACKGROUND OF THE INVENTION

In order to achieve a power increase with steam power plants in the prior art, the blading of steam turbines is often exchanged for increasing the inner efficiency. Also, a power increase is often achieved by reducing safety margins, i.e. as a rule by increasing pressure flow and mass flow. In a further method which is known in the prior art for retrofitting a steam power plant, a secondary turbine on a secondary drive shaft is connected between the steam heater and the main turbine. In this case, as a rule the main drive shaft is mechanically intercoupled with the secondary drive shaft for driving an electric generator.

SUMMARY OF INVENTION

An object based on the invention is to improve a steam power plant of the type mentioned in the introduction, and also to improve a method for retrofitting a steam power plant of the type mentioned in the introduction to the effect that the level of performance and efficiency of the steam power plant can be further increased.

This object is achieved according to the invention by a generic-type steam power plant in which the secondary turbine is designed for an operating speed which compared with a nominal speed of the main turbine is higher by at least 50%. The object is also achieved by a generic-type method in which the secondary turbine is designed for an operating speed which compared with a nominal speed of the main turbine is higher by at least 50%.

By means of the solution according to the invention, the steam conditions for the secondary turbine, which is especially designed as a high-pressure turbine or as an intermediate-pressure turbine, can be significantly increased. The operating speed of the secondary turbine, which compared with the nominal speed of the main turbine is higher by at least 50%, enables an efficiency-increasing operation of the secondary turbine with steam conditions of increased temperature and increased pressure. A conversion of these increased steam conditions into mechanical power can be carried out at the correspondingly high operating speed with increased efficiency. As a result, the delivered power of the secondary turbine is increased. After passing through the secondary turbine, the steam condition advantageously has a steam condition for which the main turbine is customarily designed. That is to say, the power which is generated by the secondary turbine is made available in addition to the power which is generated by the steam power plant before retrofitting with the secondary turbine.

Since the secondary turbine is arranged on a secondary drive shaft, retrofitting of an existing steam power plant with the secondary turbine is possible without great cost. The main drive shaft of the existing steam power plant does not have to be modified for this purpose. For the secondary turbine, which is arranged on the secondary drive shaft, only a suitable installation space in the steam power plant has to be found, and consequently the steam mass flow which leaves the steam heater has to be directed via the secondary turbine to the main turbine by means of corresponding adaptation of pipelines.

In an advantageous embodiment of the steam power plant according to the invention, the operating speed of the secondary turbine has twice the value compared with the nominal speed of the main turbine. In particular, the operating speed of the secondary turbine is 80 to 120 Hz, preferably 100 Hz. Since the nominal speed of the main turbine is half as high as the operating speed of the secondary turbine, in this case the nominal speed of the main turbine is therefore 40 to 60 Hz, preferably 50 Hz.

The secondary turbine is advantageously designed for a steam temperature of 700 to 760° C. That is to say, the steam heater is also consequently designed to generate a steam temperature of 700 to 760° C. The steam in the secondary turbine, by corresponding expansion, advantageously cools down to 520° C. to 620° C. and at this temperature is transmitted to the main turbine. The stated steam temperatures lead to a further improved efficiency and also to a further improved power output of the steam power plant.

In an expedient embodiment, the secondary drive shaft is coupled to a high-speed generator. Furthermore, the thermal power plant has an electric variable speed gear for reducing the frequency of the alternating voltage which is generated by the high-speed generator. A main generator is advantageously provided on the main drive shaft. The electric variable speed gear reduces the frequency of the alternating voltage which is generated by the high-speed generator, which is coupled to the secondary drive shaft, to the frequency of the electric alternating current which is generated by the main drive shaft. This preferably has the customary line frequency of 50 Hz. The alternating current which is generated by the secondary turbine can therefore be fed to the network together with the alternating current which is generated by the main generator without further conversion cost.

In an alternative embodiment, the secondary drive shaft is coupled to the main drive shaft via a mechanical variable speed gear. The mechanical variable speed gear especially reduces the frequency of the secondary drive shaft to the frequency of the main drive shaft. The mechanical energy which is generated by the secondary turbine is therefore transmitted to the shaft train of the main drive shaft. As a result, the electric main generator which is connected to the main drive shaft also converts the mechanical energy which is generated by the secondary turbine into electrical energy. A secondary generator, therefore, does not have to be made available.

The steam heater is advantageously designed as a live steam generator which especially has a steam boiler. The aforementioned high steam conditions can be efficiently produced in a live steam generator. Alternatively, the steam heater is designed as a reheater. With a reheater, steam, which has already passed through a first turbine, can be conditioned for feeding to the secondary turbine according to the invention. The steam heater, especially the live steam generator or the reheater, advantageously has additional superheating surfaces compared with conventional steam heaters or reheaters.

The combined use of such live steam heaters and reheaters is especially advantageous.

In order to be able to feed the steam to the secondary turbine with a temperature which is as high as possible, it is advantageous if the secondary turbine is arranged close to the steam heater, especially on a steam boiler of the steam heater. This arrangement is especially expedient for supplying super-supercritical steam conditions to the secondary turbine. Furthermore, the respective length of live steam generator lines and reheater lines is advantageously reduced to a minimum. The remaining lines can be conventionally constructed.

In a further expedient embodiment, a reheater, an additional secondary turbine and an additional main turbine which in each case are especially configured as an intermediate-pressure turbine, are connected in series downstream to the main driving turbine, wherein the additional secondary turbine is arranged on the secondary drive shaft, and the additional main turbine is arranged on the main drive shaft. With this arrangement, a further increase of the level of performance and efficiency of the steam power plant can be achieved. The expanded steam which leaves the first main turbine is brought again to a high steam condition, with preferably a temperature of about 720° C., by means of the reheater. When passing through the additional secondary turbine additional power is fed to the secondary drive shaft which increases the electrical output of the electric generator which is coupled to it. A low-pressure turbine is also advantageously located on the main drive shaft.

In an advantageous embodiment of the method according to the invention, the steam heater is retrofitted with additional superheating surfaces. This retrofitting with additional superheating surfaces especially takes place in the case of a steam generator which is configured as a steam heater. The steam heater which is retrofitted in such a way can produce higher steam conditions as a result. This in turn enables improved operation of the steam power plant which is retrofitted with the secondary turbine.

In a further advantageous embodiment of the method according to the invention, the nominal speed of the secondary turbine, compared with the nominal speed of the main turbine, has twice the value, this being especially 80 to 120 Hz, preferably 100 Hz. Furthermore, the secondary turbine is expediently designed for a steam temperature of 700 to 760° C. Furthermore, the steam power plant is advantageously retrofitted with a high-speed generator and also with an electric variable speed gear, the high-speed generator is coupled to the secondary drive shaft, and also the electric variable speed gear is coupled to the high-speed generator for reducing the frequency of the alternating voltage which is generated by the high-speed generator. Furthermore, the steam power plant is expediently retrofitted with a mechanical variable speed gear, and the secondary drive shaft is coupled to the main drive shaft via the mechanical variable speed gear. In a further advantageous embodiment, the secondary turbine is arranged close to the steam heater, especially on a steam boiler of the steam heater. In a further expedient embodiment, an additional secondary turbine is arranged downstream of a reheater of the steam power plant, and also an additional main turbine is arranged downstream of the additional secondary turbine. The additional main turbine and the additional secondary turbine are configured in each case as intermediate-pressure turbines, wherein the additional secondary turbine is arranged on the secondary drive shaft, and the additional main turbine is arranged on the main drive shaft. The advantages which are specified above with regard to the advantageous embodiments of the steam power plant according to the invention also relate to the corresponding advantageous embodiments of the method according to the invention for retrofitting a steam power plant.

BRIEF DESCRIPTION OF THE DRAWINGS

An exemplary embodiment of a steam power plant according to the invention, and also an exemplary embodiment of the method according to the invention for retrofitting a steam power plant, are subsequently explained in more detail with reference to the attached schematic drawings. In the drawing.

DETAILED DESCRIPTION OF INVENTION

Figure 1:
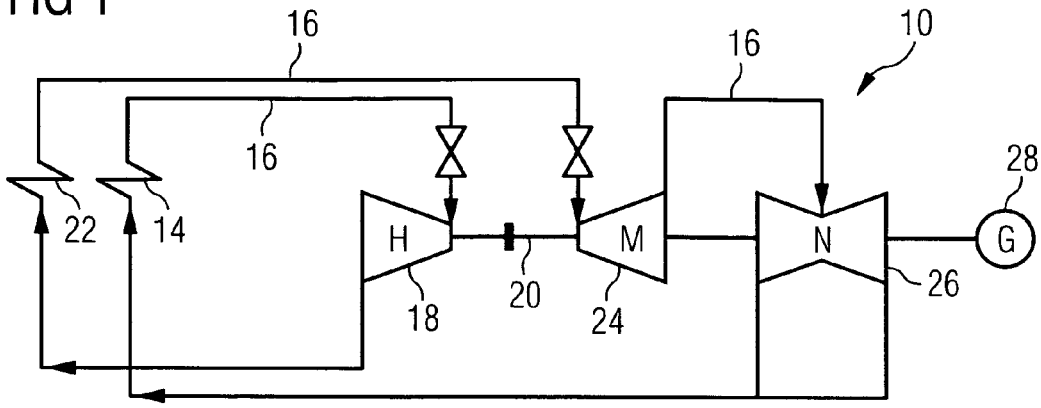
FIG. 1 shows a schematic view of a steam power plant before retrofitting according to the invention, and also
Figure 2:
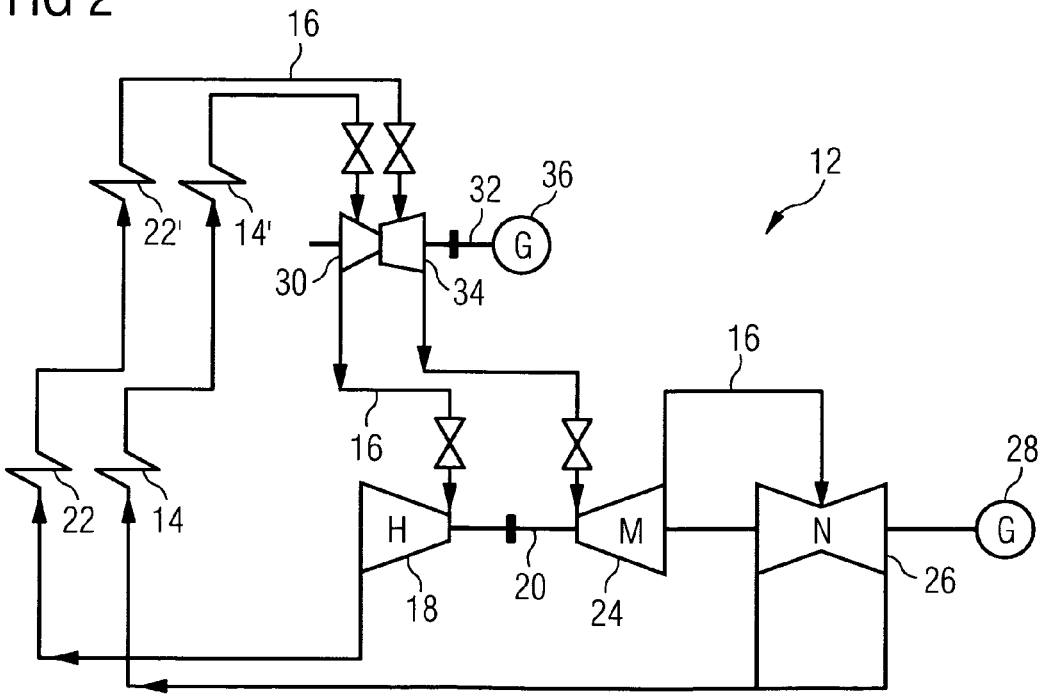
FIG. 2 shows a schematic view of a steam power plant which has been retrofitted according to the invention.

FIG. 1 shows a conventional steam power plant 10 before retrofitting according to the invention, whereas FIG. 2 shows a steam power plant 12 which has been retrofitted according to the invention, or a corresponding newly produced steam power plant 12. The steam power plant 10 according to FIG. 1 is equipped with a live steam generator 14 which serves as a steam heater. Either steam at low temperature or liquid is fed to the live steam generator 14, which steam or liquid the live steam generator 14 converts into steam of high pressure and high temperature and therefore steam of a high steam condition. The live steam is subsequently fed via a steam line 16 to a first main turbine 18, which is designed as a high-pressure turbine, in which this steam expands, driving a main drive shaft 20 which is connected to the first main turbine 18.

The expanded and therefore cooled steam is subsequently fed to a reheater 22, in which reheating of the steam is carried out. After that, the steam is fed via a further steam line 16 to a second main turbine 24 which is designed as an intermediate-pressure turbine. After that, the steam once again expands and transmits additional torque to the main turbine drive shaft 20. After leaving the second main turbine 24, the steam is fed to a low-pressure turbine 26 in which this steam further expands, again transmitting torque to the main drive shaft 20. An electric main generator 28 is connected to the main drive shaft 20 by means of which the mechanical energy of the main drive shaft 20 is converted into electrical energy.

The high-pressure, intermediate-pressure and also low-pressure turbines which are used in the steam power plant 10 according to FIG. 1, are designed for steam conditions which are customary for such turbines. High-pressure turbines as a rule are designed for a temperature of 520 to 600° C. and a pressure of 120 to 300 bar. Intermediate-pressure turbines as a rule are designed for absorption of also 520 to 600° C. hot steam at a pressure of 30 to 60 bar. Low-pressure turbines as a rule are designed for 4 to 10 bar pressure.

A steam power plant 12 after retrofitting according to the invention for increasing the level of performance and efficiency of the steam power plant, is shown in FIG. 2. Elements of the steam power plant 12, which coincide with the corresponding elements of the steam power plant 10 which is shown in FIG. 1, are identified with the same designations. With regard to their function, reference is made to the embodiments in relation to FIG. 1. The steam power plant 12, compared with the steam power plant 10, is first equipped with an additional steam heater 14', which is connected downstream to the live steam generator 14, for additional heating of the live steam to about 700° C. In this case, the function of the additional steam heater 14' can also be integrated into the live steam generator 14. In this way, the steam generator 14 for example can be equipped with additional superheating surfaces for higher steam conditions, or in the case of new production of the steam power plant which is shown in FIG. 2, can be designed for higher steam states from the outset.

Furthermore, the steam power plant 12 is equipped with, or retrofitted with, a first secondary turbine 30 which is arranged on a secondary drive shaft 32. The first secondary turbine 30 is designed as a high-pressure turbine which is designed for absorption of 700° C. hot steam. In the first secondary turbine 30, the live steam, which is fed at a temperature of about 700° C., expands and cools down to 560° C. to 620° C. in the process. In this case, the first secondary turbine 30 drives an electric secondary generator 36 via the secondary drive shaft 32. The expanded steam is then directed into the first main turbine 18 via a steam line 16. After corresponding expansion in the first main turbine 18, the steam is fed to the reheater 22 and also to a downstream secondary reheater 22'. As already explained with regard to the live steam generator 14 and the secondary steam heater 14', the secondary reheater 22' can also be functionally integrated into the reheater 22. This can also be brought about in this case by additional superheating surfaces in the reheater 22.

After passing through the secondary reheater 22', the steam for example has a temperature of 720° C. and is subsequently directed into a second secondary turbine 34, which is designed as an intermediate-pressure turbine and designed for a steam temperature of over 720° C. The second secondary turbine 34 is also arranged on the secondary drive shaft 32. The arrangement of a plurality of drive shafts according to the steam power plant 12 with the main drive shaft 20 and the secondary drive shaft 32 is also referred to as a multi-shaft arrangement. The second secondary turbine 34 imparts additional torque to the secondary drive shaft 32.

The first secondary turbine 30 and the second secondary turbine 34 are designed for a speed which is twice as high as the nominal speed of the main turbines 18, 24 and 26. The secondary drive shaft 32 is preferably driven with a frequency of 100 Hz compared with a drive frequency of the main drive shaft 20 of 50 Hz. In the embodiment of the steam power plant 12 which is shown in FIG. 2, the electric secondary generator 36 is coupled to the electric main generator 28 via an electric variable speed gear which is not shown in the drawing. In a further embodiment, which is not shown in the drawing, the secondary drive shaft 32 and the main drive shaft 20 can also be coupled by means of a mechanical variable speed gear. In this case, an electric generator is only necessary for converting the mechanical energy into electric current.

The invention claimed is:

1. A steam power plant with at least one steam heater for providing compressed steam, comprising:

a main turbine connected downstream to the steam heater, arranged on a main drive shaft and designed for operation with high-pressure and intermediate-pressure steam; and a secondary turbine connected between the steam heater and the main turbine and arranged on a secondary drive shaft, wherein the secondary turbine operating speed is at least 50% greater than the main turbine nominal operating speed;

and wherein the secondary drive shaft is coupled to the main drive shaft via a mechanical variable speed gear.

2. The steam power plant as claimed in claim 1, wherein the operating speed of the secondary turbine is twice the nominal speed of the main turbine.

3. The steam power plant as claimed in claim 2, wherein the operating speed of the secondary turbine is 80 to 120 Hz.

4. The steam power plant as claimed in claim 1, wherein the secondary turbine steam is 700° C. to 760° C.

5. The steam power plant as claimed in claim 1, wherein the secondary drive shaft is coupled to a high-speed generator, and also the steam power plant has an electric variable speed gear that reduces the frequency of the alternating voltage generated by the high-speed generator.

6. The steam power plant as claimed in claim 1, wherein the steam heater is a live steam generator.

7. The steam power plant as claimed in claim 6, wherein the steam heater is a steam boiler.

8. The steam power plant as claimed in claim 1, wherein the secondary turbine is arranged on a steam boiler of the steam heater.

9. The steam power plant as claimed in claim 1, further comprising a reheater, an additional secondary turbine and an additional main turbine are configured in each case as an intermediate-pressure turbine and are connected in series downstream of the main turbine, wherein the additional secondary turbine arranged on the secondary drive shaft, and the additional main turbine is arranged on the main drive shaft.

10. A method for retrofitting a steam power plant with at least one steam heater for providing steam, comprising:

connecting a main turbine to the steam heater and arranged downstream of the steam heater and on a main drive shaft, wherein the main turbine operates with high-pressure or intermediate-pressure steam;

retrofitting the steam power plant with a secondary turbine arranged on a secondary drive shaft wherein the secondary turbine is connected between the steam heater and the main turbine;

operating the secondary turbine at a rotational speed at least 50% greater than the nominal speed of the main turbine;

retrofitting the steam power plant with a mechanical variable speed gear; and coupling the secondary drive shaft to the main drive shaft via the mechanical variable speed gear.

11. The method as claimed in claim 10, wherein the operating speed of the secondary turbine is 80 to 120 Hz.

12. The method as claimed in claim 10, further comprising retrofitting the steam heater with additional superheating surfaces.

13. The method as claimed in claim 10, wherein the secondary turbine steam temperature is 700° C. to 760° C.

14. The method as claimed in claim 10, further comprising retrofitting the steam power plant with a high-speed generator and with an electric variable speed gear, coupling the high-speed generator to the secondary drive shaft, and coupling the electric variable speed gear to the high-speed generator for reducing the frequency of the alternating voltage generated by the high-speed generator.

15. The method as claimed in claim 10, wherein the secondary turbine is arranged on a steam boiler of the steam heater.

16. The method as claimed in claim 10, further comprising arranging an additional secondary turbine downstream of a reheater of the steam power plant, and arranging an additional main turbine downstream of this additional secondary turbine, which additional turbines are especially configured in each case as an intermediate-pressure turbine, wherein the additional secondary turbine is arranged on the secondary drive shaft, and the additional main turbine is arranged on the main drive shaft.

* * * * *